United States Patent [19]

Geusic

[11] Patent Number: 4,913,973

[45] Date of Patent: Apr. 3, 1990

[54] PLATINUM-CONTAINING MULTILAYER ANODE COATING FOR LOW PH, HIGH CURRENT DENSITY ELECTROCHEMICAL PROCESS ANODES

[75] Inventor: Mark J. Geusic, Berkley Heights, N.J.

[73] Assignee: Engelhard Corporation, Edison, N.J.

[21] Appl. No.: 243,182

[22] Filed: Sep. 8, 1988

Related U.S. Application Data

[63] Continuation of Ser. No. 97,379, Sep. 16, 1987, abandoned, which is a continuation of Ser. No. 941,577, Dec. 15, 1986, abandoned, which is a continuation of Ser. No. 775,911, Sep. 13, 1985, abandoned.

[51] Int. Cl.[4] ..... B32B 3/02

[52] U.S. Cl. ..... 428/469; 428/632; 428/670; 148/20.3; 204/290 F

[58] Field of Search ..... 428/469, 632, 670; 148/20.3; 204/290 F; 427/38

[56] References Cited

U.S. PATENT DOCUMENTS

| | | | |
|---|---|---|---|
| 4,049,513 | 9/1977 | Meyers | 204/290 F |
| 4,203,810 | 5/1980 | Warne et al. . | |
| 4,260,665 | 4/1981 | Aida et al. | 428/670 |
| 4,331,528 | 5/1982 | Beer et al. | 204/290 F |
| 4,372,824 | 2/1983 | Toda et al. . | |
| 4,399,199 | 8/1983 | McGill et al. | 428/670 |
| 4,528,083 | 7/1985 | LaContiet et al. | 204/290 F |
| 4,528,084 | 7/1985 | Beer et al. | 204/290 F |

FOREIGN PATENT DOCUMENTS

| | | |
|---|---|---|
| 0026482 | 4/1981 | European Pat. Off. . |
| 0027367 | 4/1981 | European Pat. Off. . |
| 0046447 | 2/1982 | European Pat. Off. . |
| 0090425 | 10/1983 | European Pat. Off. . |
| 0129374 | 12/1984 | European Pat. Off. . |

OTHER PUBLICATIONS

PATENT ABSTRACTS OF JAPAN, C. Field, vol. 4, No. 178, 12/10/80, unexamined applications, THE PATENT OFFICE JAPANESE GOVT, Shin Nippon Seitetsu K.K.

PATENT ABSTRACTS OF JAPAN, C. Field, vol. 5, No. 106, 7/10/81, unexamined applications, THE PATENT OFFICE JAPANESE GOVT, Shin Nippon Seitetsu K.K.

PATENT ABSTRACTS OF JAPAN, E Section, vol. 1, No. 37, 4/18/77, unexamined applications, THE PATENT OFFICE JAPANESE GOVT, Kiyoteru Takayasu.

F. Hine, K. Takayasu, N. Koyanagi, "A Platinized Titanium Anode for Chromium Electroplating", 5/12/85, pp. 346–349.

Tomoyoshi Asaki and Yoichi Kamegaya, Kiyoteru Takayasu, "Field Test of Platinized Titanium Anodes for Hypochlorite Cells", May 6, 1984.

*Primary Examiner*—Patrick Ryan

[57] ABSTRACT

The present invention is directed to a novel anode suitable for producing high purity, pore-free coper foil at high speed and low cost under severe conditions. The anodes of the present invention are capable withstanding high acid concentrations, current densities and temperatures which would rapidly destroy the prior art anodes. This is accomplished by producing the anodes of the present invention by a new and novel process which results in structural superior anodes. The anodes of the present invention are produced by first electrodepositing on a valve metal substrate platinum to a thickness of at least about 150 microinches to about 400 microinches. The next step in the process involves "densification" of the platinum layer by heat treatment so as to close the pores of the platinum layer. This results in a substantially closed pore platinum layer. The final step in the process comprises applying a catalytic oxide outer coating consisting essentially of iridium oxide and rhodium oxide, applied by thermal decomposition at temperatures of no more than 600° C. The resulting electrode is structurally different from the prior art electrodes and superior in operation and use.

8 Claims, No Drawings

PLATINUM-CONTAINING MULTILAYER ANODE COATING FOR LOW PH, HIGH CURRENT DENSITY ELECTROCHEMICAL PROCESS ANODES

This is a continuation of co-pending application Ser. No. 097,379 filed on Sept. 16, 1987 which is a continuation of 941,577 filed Dec. 15, 1986 which is a continuation of 775,911 filed Sept. 13, 1985.

Electroformed copper foils are the backbone of modern electronic devices. As integrated circuits have found their way into ever increasing numbers of products, the quantity of foil required has increased correspondingly yet the rate at which these foils could be produced has been limited because even the best dimensionally stable anodes available were not capable of withstanding the conditions required for optimum foil production.

SUMMARY OF THE INVENTION

In accordance with the present invention there is provided an anode for oxygen evolution consisting essentially of a substrate of a film forming metal having thereon a multilayer coating comprising an interior layer and an exterior layer, as follows. The interior layer consists essentially of substantially pore free platinum applied electrolytically to a thickness of at least about 150 microinches, e.g., about 150 to 400 microinches, then densified by heat treating in an oxygen containing atmosphere at from 600° C. to 775° C. so as to close the pores in the platinum layer. The exterior layer consists essentially of at least about 97% iridium oxide and up to about 3% rhodium oxides, said exterior layer having been applied by thermal decomposition of one or more thermally decomposable iridium and, optionally, rhodium compounds in an oxygen containing atmosphere at a temperature of not more than about 600° C., e.g., at a temperature of from 400° C. to 550° C., or from about 450° C. to about 500° C.

Other aspects of the invention are described in the following detailed description.

DETAILED DESCRIPTION OF THE INVENTION AND PREFERRED EMBODIMENTS THEREOF

The anodes of the present invention are particularly suitable for producing high purity, pore-free copper foils at high speed and low cost under severe conditions because these anodes withstand high acid concentrations, current densities and temperatures which would rapidly destroy the anodes known to the prior art. In particular, the anodes of the present invention are formed by a three step process which is extremely sensitive in its details but, when carried out properly, produces extremely robust and durable anodes.

In the first step of the process, platinum is electrodeposited on a valve metal substrate which has been thoroughly descaled, degreased and cleaned. It is critical that the platinum be applied to a thickness of from at least about 150 microinches up to about 400 microinches, preferably the thickness will be at least about 225 microinches, more preferably at least about 250 microinches.

The second step of the process involves a thermal treatment referred to as "densification" which is essential for obtaining the anodes of the present invention. In the "densification" step, the platinum coated anode is heated in air and maintained at a temperature between 600° and 775° C. for about ¼ to 2 hours or until the stress is relieved in the electrodeposited coating and pores resulting from the electrodeposition process have closed.

The final step in the process is applying a catalytic oxide outer coating consisting essentially of at least about 97% IrOhd 2 and up to about 3% $Rh_2O_3$ by applying thermally decomposable iridium and rhodium compounds to the "densified" platinum coated substrate, then decomposing the compounds by heating in air to form the oxides. It has been found that it is essential to effect the decomposition at temperatures of no more than about 600° C. as the products formed are much less durable when higher temperatures (for example, around 690° C.) are used. The amount of the thermally decomposable compounds applied should be sufficient to provide a loading of at least about 15 $g/m^2$ of iridium (calculated based on the weight of the metal), preferably 20 $g/m^2$, more preferably 25 $g/m^2$.

The substrates to which the coating is applied may be any of the well known film forming metals which, if uncoated, will rapidly passivate by formation of an adherent protective oxide film in the electrolyte for which the anode is intended. Typical substrates are formed from titanium, tantalum, vanadium, tungsten, aluminum, zirconium, niobium and molybdenum in the form of tubes, rods, sheets, meshes, expanded metals or other specialized shapes for specific applications. For formation of electrolytic copper foil, it is particularly preferred to use anodes in the shape of cylinders or as a portion of a cylinder which conform to the shape of the mandrel or drum so that the electrolytically formed foil will be of uniform thickness and may easily be removed from the cathode drum. In many cases, the core of the anode will be copper or another highly conductive metal such as aluminum or highly conductive ferrous alloys clad with a film forming metal outer layer such as titanium.

Prior to application of the electrolytic layer, the substrate is cleaned and descaled such as by blasting with aluminum oxide particles in an air jet, then chemically cleaned and degreased. Normally, the anode is coated immediately subsequent to degreasing but the anodes may be stored for for a few days between degreasing and coating without ill effect.

The electrolytic coating of platinum may be applied by immersing the substrate in an aqueous, platinum, electroplating bath opposite a conventional dimensionally stable counterelectrode and passing a current of from about 7 to about 70 amps per square foot through the substrate until at least 150, preferably 225, more preferably 250 microinches of platinum have been applied. Any conventional platinum electroplating bath may be used. Typically, such baths are in aqueous dispersons, solutions or admixtures containing compounds of platinum such as ammine, nitrito or hydroxy complexes, as well as various known additives for brightening, improving the ductility of the deposited film and isolating impurities as well as improving the conductivity of the bath. Typical platinum compounds include $H_2PtCl_6$, $K_2Pt(OH_2)$, $H_2Pt(NO_2)_2SO_4$ and diammine dinitroplatinum (II). Useful formulations for platinum electroplating baths are disclosed in F. Lowenheim, *Modern Electroplating,* 3rd Ed. 1974, pp. 355–357 and F. Lowenheim, *Electroplating,* McGraw Hill 1978, pp. 298–299. Prepared concentrates for preparing and replenishing platinum electroplating baths are commercially available. To achieve a high quality platinum layer, the temperature of the bath should preferably be maintained at from about 150° to about 200° F. (65° to 93° C.).

After the platinum coat has reached the desired thickness, the anode may be removed from the bath and subjected to a thermal treatment termed "densification" to stress relieve the coating and close pores therein. If the "densification" step is omitted, or not performed properly, the anodes formed are less durable as they passivate prematurely. Thermal densification can be accomplished by heating the platinum coated anode in air, nitrogen, helium, vacuum or any convenient atmosphere to a temperature of between about 550° C. and 850° C. for from about 15 minutes to several hours depending on the nature of the as deposited platinum film. It may be determined that the thermal densification step is complete by visually observing the coating and noting when pore closure occurs and the coating becomes much more highly reflective.

After thermal densification is complete, the anode may be cooled then coated with an iridium oxide outer layer by thermal decomposition of iridium containing compounds in an oxygen containing atmosphere. Iridium compounds that may be used include hexachlororidic acid $(NH_4)_2IrCl_6$ and $IrCl_4$, as well as iridium resinates and other halogen containing compounds. Typically, these compounds are dispersed in any convenient carrier such as isobutanol, and other aliphatic alcohols, then applied to the substrate by any convenient method such as dipping, brushing on or spraying. In most cases an amount of iridium bearing carrier is applied which is sufficient to deposit a loading of from about 0.5 to about 3.0 grams per square meter, preferably 1 to 2 grams per square meter, of iridium (calculated as metal) on the substrate, which is then fired in air at from about 400° C. to no more than about 550° C., preferably 450° C. to about 500° C., to drive off the carrier and convert the iridium compounds to the oxides. This procedure is repeated until the total amount of iridium applied is at least about 15, preferably at least about 20, more preferably at least about 25 grams per square meter (calculated as metal). The temperature of the thermal decomposition step is extremely critical. As will be demonstrated in the following Examples, when a decomposition temperature in excess of about 600° C. is used for decomposition of the iridium compounds, the resulting anode is much less durable, but when the iridium compound is decomposed at temperatures of 600° C. or below, preferably from about 400° C. to about 550° C., more preferably from 450° C. to 500° C., the resulting anode is surprisingly durable and long lived even when evolving oxygen in baths at temperatures in excess of about 65° C. which will normally ruin the prior art anodes in short order.

In many cases, it will be advantageous to include up to about 3% $Rh_2O_3$ in the iridium oxide film to promote adhesion. This may be accomplished by incorporation of any convenient, conventional rhodium compound into the iridium bearing coating composition. Rhodium resinates are particularly convenient.

Copper foils may be electroformed using the anodes of the present invention by immersing the anode in a bath at a pH of from −0.2 to 3 containing suitable copper species such as copper sulfate, copper chloride and other soluble copper compounds opposite a cathode such as stainless steel or other corrosion resistant alloys and passing a current of from about 400 to about 2,000 amps per square foot of anode (4,300 to 21,000 A/m$^2$) through the bath and evolving oxygen at the anode. It is considered particularly surprising that the anodes of the present invention exhibit high durability even when used at bath temperatures in excess of 65° C. up to about 90° C. It is also considered surprising that anodes of the present invention remain suitable for use at a sulfuric acid concentration from about 100 to about 250 grams/liter even when operating at current densities from about 500 up to about 3,000 amps per square foot (5,400 to 32,000 A/m$^2$). Under these conditions, prior art anodes rapidly become useless and even anodes similar to the present invention, but not prepared strictly in accordance therewith, fail rapidly. It is extremely desirable for copper foil producers to be able to use these severe conditions as under these conditions more efficient, rapid and economical production of foil can be achieved. Thus, the anodes of the present invention satisfy a long felt but unsatisfied need for anodes which were capable of being used under conditions which are suitable for high speed, energy efficient production of high purity, pore free films of electrolytic copper foil. They are also extremely suitable for those applications in which a porous foil is desired as well as for other applications involving oxygen evolution such as electrogalvanizing, electrowinning and electrosynthesis.

EXAMPLE 1

This Example illustrates the production of an anode in accordance with the present invention. A substrate of titanium of dimensions 4" by 8" by 0.062" was descaled, cleaned and degreased, then electrolytically coated with platinum to a thickness of 250 microinches. The platinum coating was then densified by heating in air at 690° C. for ¾ hour. After cooling, a coating consisting of about 98% $IrO_2$ and 2% $Rh_2O_3$ was applied by painting the substrate with a solution of hexachlororidic acid and a rhodium resinate dispersed in butanol, then firing in air at 450° C. and repeating this procedure 15 times until the coating weight reached 15 grams of iridium (as metal) per square meter. When used in electroforming of copper foils at a pH of about 0, a current density of about 1860 ASF (20,000 A/m$^2$), and a temperature of about 60° C., the anode was still operating at this writing after 4,000 hours at an essentially constant overvoltage of 2.83 volts.

EXAMPLE 2

The procedure of Example 1 was repeated except that the iridium oxide (third step) was formed at 690° C. When used under conditions similar to those in Example 1 (pH 0, current density 1860, and temperature of 60° C.) the anode failed after 620 hours.

I claim:

1. An anode for oxygen evolution consisting essentially of a substrate of a film forming metal having thereon a multilayer coating comprising:

an interior layer consisting essentially of substantially pore free platinum applied electrolytically to a thickness of at least about 150 microinches, then densified by heat treating in an oxygen containing atmosphere at from 600° to 775° C. so as to close the pores in the platinum layer; and an exterior layer consisting essentially of at least about 97% iridium oxide and up to about 3% rhodium oxide, said exterior layer having been applied by thermal decomposition of one or more thermally decomposable iridium and, optionally, rhodium compounds in an oxygen containing atmosphere at a temperature of not more than about 600° C.

2. The anode of claim 1 wherein the exterior layer is formed by thermal decomposition at a temperature of from about 400° to about 550° C.

3. The anode of claim 1 wherein the interior layer has a thickness of at least about 225 microinches.

4. The anode of claim 1 wherein the interior layer has a thickness of at least about 250 microinches.

5. The anode of claim 4 wherein the exterior layer is formed by thermal decomposition at a temperature of from about 450° to about 500° C.

6. The anode of claim 1 wherein the interior layer has a thickness of from about 150 to about 400 microinches.

7. The anode of claim 2 wherein the interior layer has a thickness of from about 150 to about 400 microinches.

8. The anode of claim 5 wherein the interior layer has a thickness of from about 250 to about 400 microinches.

* * * * *